US005195483A

United States Patent [19]

Ishida

[11] Patent Number: 5,195,483

[45] Date of Patent: Mar. 23, 1993

[54] LOCKING DEVICE FOR OUTBOARD MOTOR COWLING

[75] Inventor: Hitoshi Ishida, Hamamatsu, Japan

[73] Assignee: Sanshin Kogyo Kabushiki Kaisha, Hamamatsu, Japan

[21] Appl. No.: 872,163

[22] Filed: Apr. 22, 1992

[51] Int. Cl.[5] ..... F02B 77/00

[52] U.S. Cl. ..... 123/198 E; 440/77

[58] Field of Search ..... 123/195 P, 198 E, 198 P; 440/76, 77; 292/171, DIG. 25

[56] References Cited

U.S. PATENT DOCUMENTS

| | | | |
|---|---|---|---|
| 2,200,346 | 5/1940 | Sepull | 292/171 |
| 4,875,883 | 10/1989 | Slattery | 440/77 |
| 4,932,909 | 6/1990 | Curtis et al. | 440/77 |
| 4,971,587 | 11/1990 | Uchida et al. | 440/77 |
| 5,025,763 | 6/1991 | Watanabe | 440/77 |

*Primary Examiner*—Noah P. Kamen
*Attorney, Agent, or Firm*—Ernest A. Beutler

[57] ABSTRACT

A locking device for connecting and disconnecting the top portion and tray of a cowling of an outboard motor. A locking mechanism comprising a pair of guide members each having a bore, one affixed to the top cowling and the other affixed to the cowling tray such that the guide member bores are adjacent to and aligned with one another when the top cowling is fitted onto the tray. A movable member is slidably supported within the top cowling guide member bore and has an outer portion that is biased outward by a spring for engagement with the tray guide member bore. An inner wire slidably supported within an outer sheath interconnects the movable member with a release lever that is rotatably supported on the upper surface of the top cowling. Upward movement of the lever causes the movable member to retract into the top cowling guide member bore against the force of the spring and disengage with the tray guide member bore so that the top cowling may be unlocked and detached from the tray.

15 Claims, 5 Drawing Sheets

LOCKING DEVICE FOR OUTBOARD MOTOR COWLING

BACKGROUND OF THE INVENTION

This invention relates to a locking device for the cowling of an outboard motor, and more particularly to an improved cowling locking device which can be easily accessed and operated for connecting and disconnecting the top portion of the cowling from the cowling tray.

It is well known in the art of outboard motors that the powering internal combustion engine is normally enclosed within a protective cowling so as to provide protection for the engine, to suppress engine noise, to protect users from coming into contact with the engine, and to provide a better appearance for the outboard motor.

One type of cowling includes a top cover and a tray portion that is affixed to the lower end of the internal combustion engine. The top cover has a generally inverted cup shape and is removably attached to the tray member. When so attached, this top cover defines a cavity in which the engine is contained.

Cowling structures of this type usually contain a locking or latching mechanism for securely connecting the top and tray members together during use of the outboard motor. One such locking mechanism includes a clamp for locking the top cowling portion to the cowling tray and a release lever for opening and closing this clamp. This release lever has typically been installed near where the top cowling meets the tray portion on the back of the power head on the propeller side of the outboard motor. As a result, it is necessary to support the body weight and maintain balance with the one hand while reaching around or over the power head with the other hand in order to operate the release lever. This can be difficult, especially under adverse conditions such as high winds or cold weather.

Another type of latching mechanism utilizes keepers secured to the top cowling which are engageable with corresponding latches that are secured to the cowling tray. An operating lever supported for rotation about a vertical shaft is operatively connected to the latches for releasing them when the lever is pulled so that the top portion of the cowling may be detached from the tray. This operating lever is installed on the front side of the power head near where the two cowling components meet when they are fitted together. An example of such an arrangement is provided in U.S. Pat. No. 5,025,763. Although this type of latching mechanism has certain advantages, the lower positioning of the operating lever can sometimes make it difficult to access and/or operate.

It is, therefore, a principal object of this invention to provide an improved cowling locking device which can be easily accessed and operated for connecting and disconnecting the top portion of the cowling from the tray portion.

It is another object of this invention to provide an improved cowling locking device for connecting and disconnecting the top portion of the cowling from the tray portion which includes a release lever that is positioned on an upper surface of the top portion of the cowling for easy access and operability.

SUMMARY OF THE INVENTION

This invention is adapted to be embodied in a locking device for connecting a top portion and tray of a cowling of an outboard motor. The locking device comprises an operating mechanism positioned on an upper surface of the top portion of the cowling and movable relative to the top portion. A locking mechanism is positioned remotely from the operating mechanism for connecting the top portion and tray of the cowling with each other. The invention further includes means for transmitting movement of the operating mechanism to the locking mechanism for unlocking the top portion and tray of the cowling from each other.

DETAILED DESCRIPTION OF THE PREFERRED EMBODIMENT OF THE INVENTION

Figure 1:
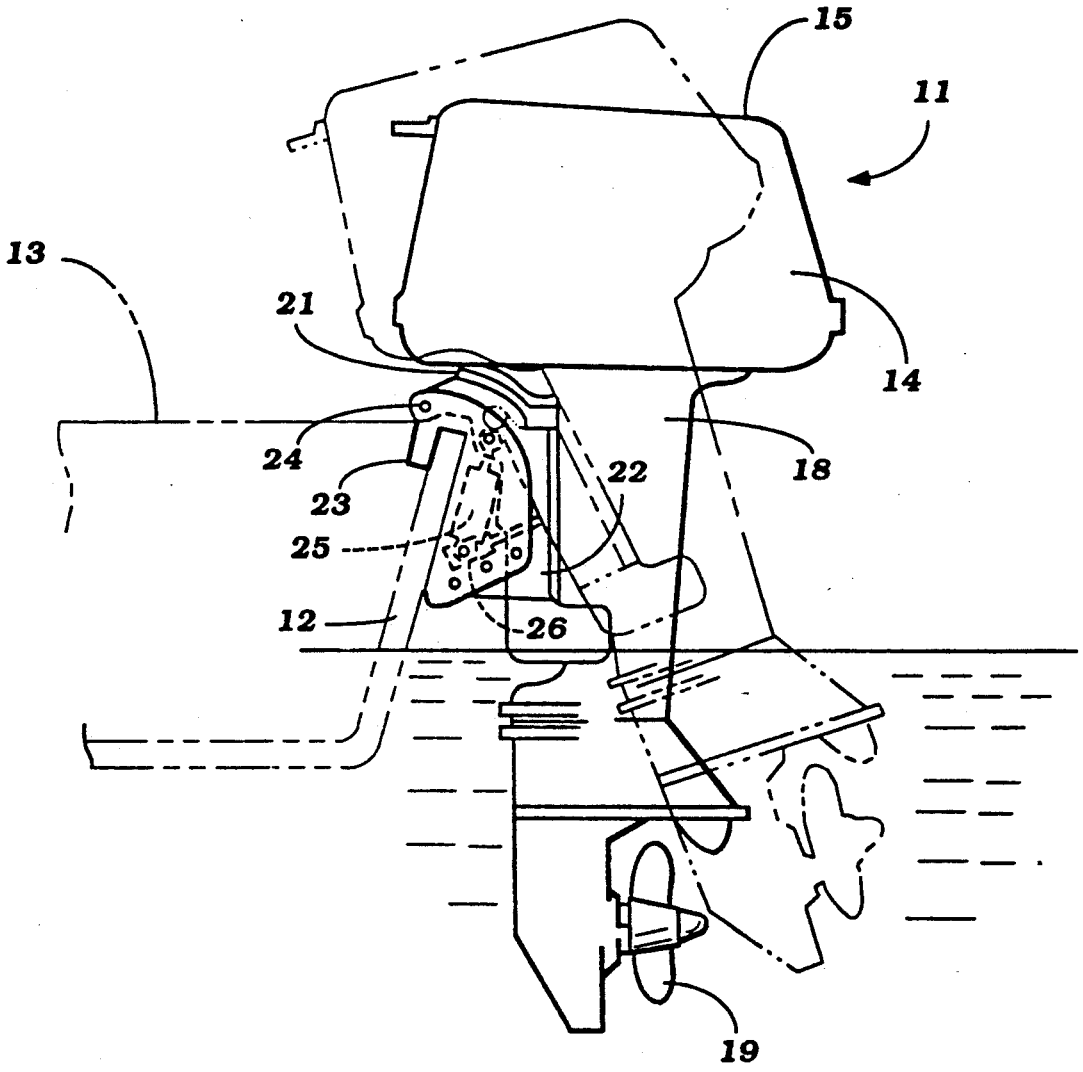
FIG. 1 is a side elevational view of an outboard motor attached to the transom of an associated watercraft and constructed in accordance with an embodiment of the invention.

Referring first to FIG. 1, an outboard motor constructed in accordance with an embodiment of the invention is identified generally by the reference numeral 11 and is shown as attached to the transom 12 of the hull 13 of an associated watercraft. The outboard motor 11 includes a power head that contains an internal combustion engine 14 which is surrounded by a protective cowling 15 having a top portion 16 and a bottom or tray portion 17 (see FIG. 2) constructed in accordance with the invention. The top portion 16 of the cowling 15 has a generally inverted bowl shape and is mounted on the tray portion 17 which generally takes the shape of a shallow upright bowl.

The internal combustion engine 14, which is not shown in any detail in the figures and which may be of any known type, drives an output shaft which, in turn, drives a driveshaft that is journaled for rotation within a driveshaft housing 18 that depends from the power head. This driveshaft (not shown) drives a propeller 19 of a lower unit by means of a conventional forward, reverse, neutral transmission (not shown).

A steering shaft is affixed to the driveshaft housing 18 in a known manner and is supported for steering movement about a generally vertically extending steering axis within a steering bracket 21 of a swivel bracket assembly 22.

The swivel bracket assembly 22 is pivotally connected to a clamp bracket 23 by means of a tilt shaft 24 for tilt and trim movement of the outboard motor 11. The clamp bracket 23 includes means for affixing the outboard motor 11 to the transom 12 of the associated watercraft. The tilting of the outboard motor 11 is accomplished by means of a tilt cylinder identified by the reference numeral 25 and which extends between the swivel bracket 22 and clamp bracket 23. The trim position of the outboard motor 11 is adjusted by a pair of trim cylinders 26 which extend between the swivel bracket 22 and clamp bracket 23.

The construction of the outboard motor 11 as thus far described may be considered conventional and, for that reason, those components which are not illustrated and which have not been described in any more detail may take the form of any of the known components used in this field.

Figure 2:
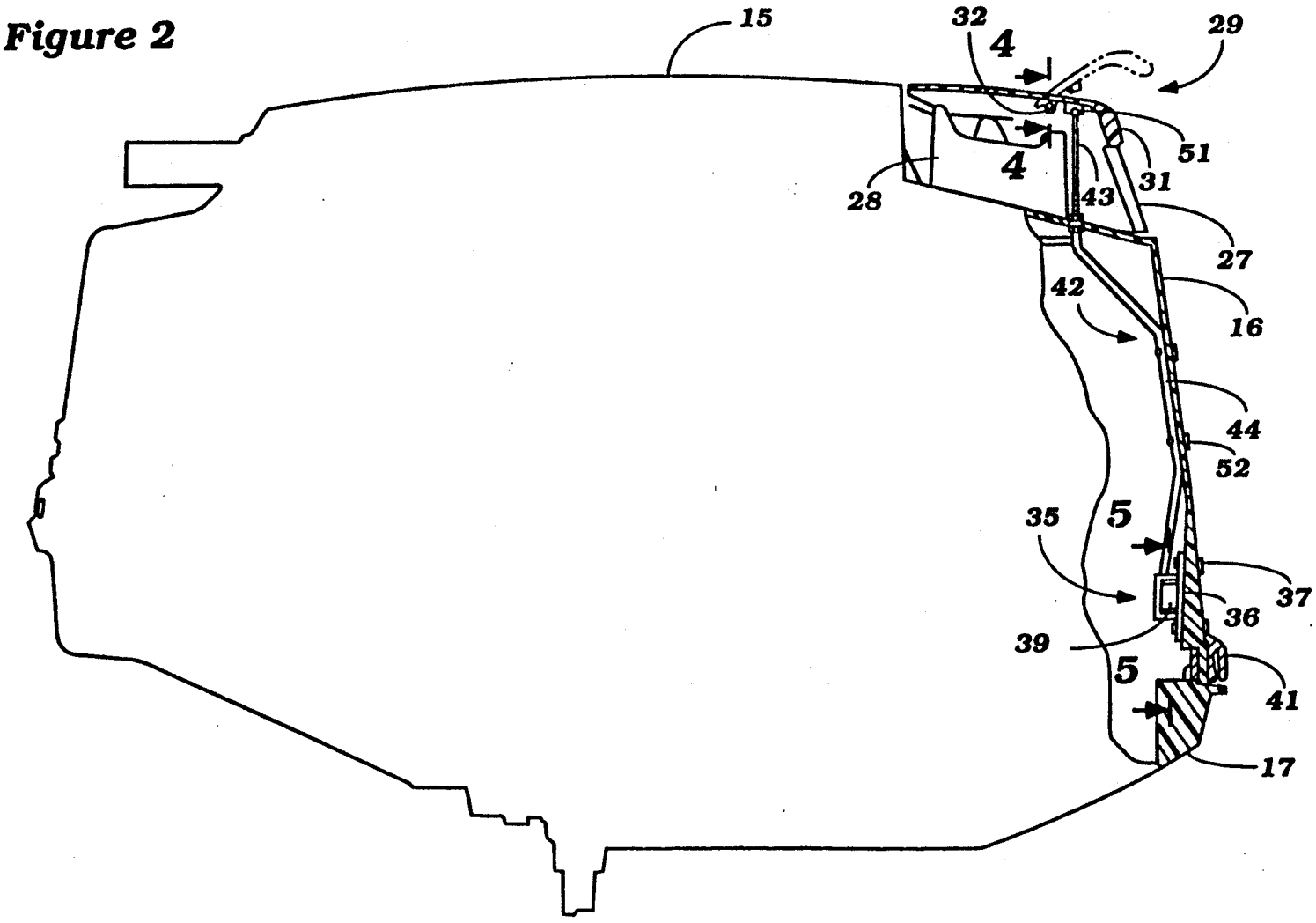
FIG. 2 is a side elevational view of the power head of the outboard motor showing the locking device including the release lever of the operating mechanism in its locked position in solid lines and in its released position in phantom.
Figure 3:
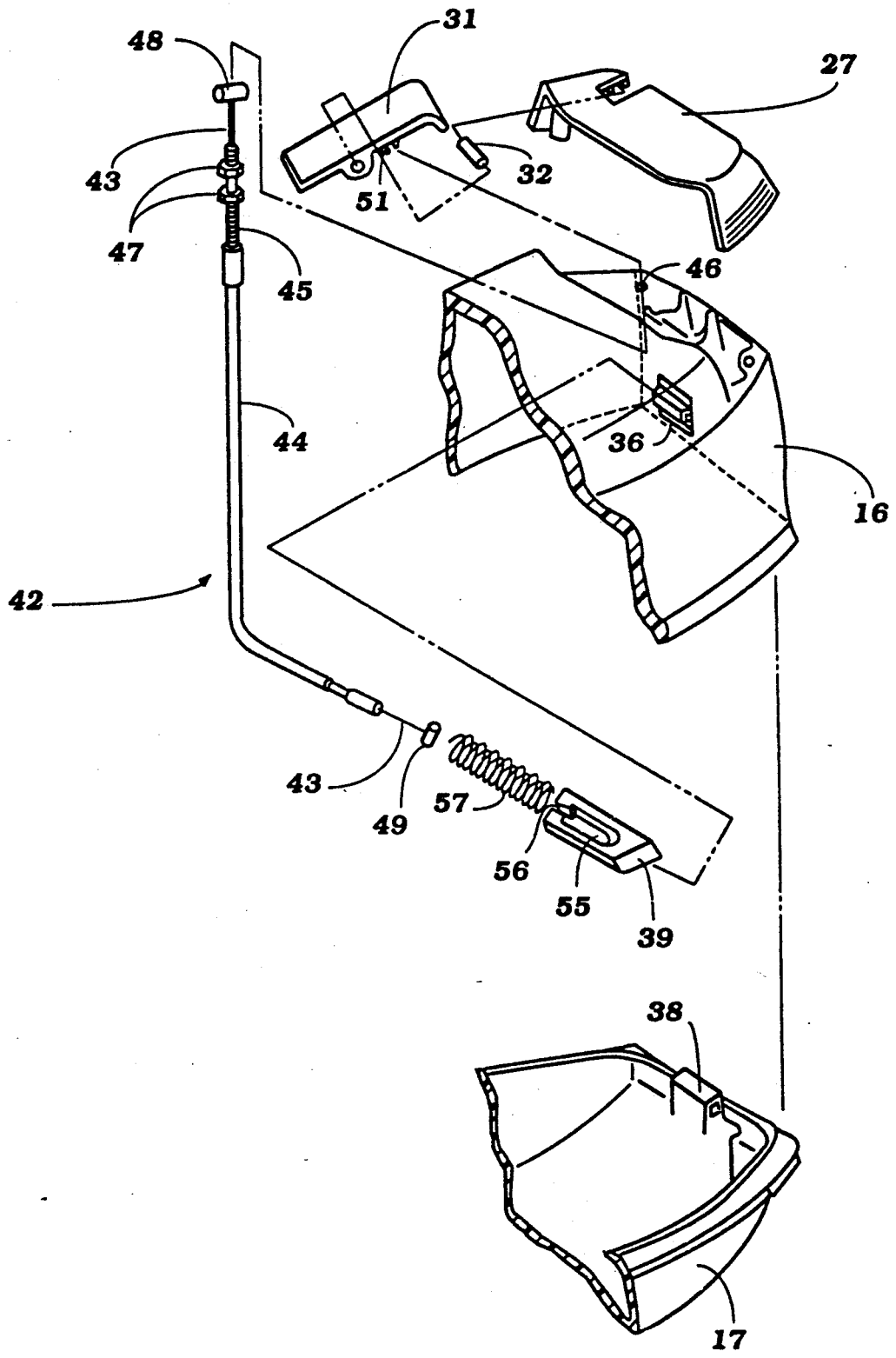
FIG. 3 is an exploded view of the locking device constructed in accordance with an embodiment of the invention.
Figure 4:
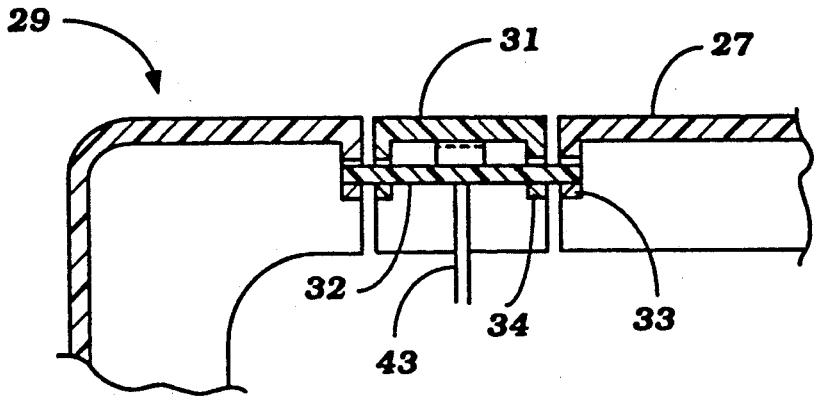
FIG. 4 is a cross sectional view taken along line 4—4 in FIG. 2 showing the release lever of the locking device.

Referring now primarily to FIGS. 2, 3 and 4, an air inlet is formed in the upper rear portion of the top cowling 16 and includes an air duct molding 27 that is fitted into the air inlet to form a rearwardly facing opening. An air intake duct 28 is formed on the base of the air inlet for supplying air that is drawn in through the air inlet into the interior of the cowling 15 for use by the engine induction system. The top surface of the air duct molding 27 lies in the same general plane as the upper surface of the top cowling 16 so as to provide a uniform and continuous appearing surface when the air duct molding 27 is fitted onto the top cowling 16. The top of the air duct molding 27 is positioned above the air intake duct 28 to prevent foreign objects from falling into the duct 28.

The air duct molding 27 has a cut out portion to accommodate an operating mechanism identified generally by the reference numeral 29. This operating mechanism 29 comprises a release lever 31 which is rotatably supported on a pin 32 that has its ends fitted into the side walls 33 and 34 of the cut out portion of the air duct molding 27 as shown in FIGS. 3 and 4.

In accordance with the invention, a locking mechanism, identified generally by the reference numeral 35, is provided for locking the top cowling 16 to the cowling tray 17. The locking mechanism 35 is comprised of a first guide member 36 that is fixed by means of rivets 37 or other suitable means to the inside wall of the top cowling 16 near its lower edge. A second guide member 38 projects from the inner wall of the tray 17 near its upper edge. These guide members 36 and 38 are positioned so that are adjacent to and aligned with one another when the top cowling 16 is fitted on the tray portion 17. The locking mechanism 35 further includes a plunger element 39 slidably moveable within the first guide member 36 and selectively engageable and disengageable with the second guide member 38 so as to connect and disconnect the top cowling 16 to the tray 17. A sealing member 41 is interposed between the adjoining edges of the top and tray cowling portions 16 and 17.

A wire cable, identified generally by the reference numeral 42, interconnects the release lever 31 with the plunger 39. The cable 42 includes an inner wire 43 which is slidably supported within an outer protective sheath 44 and a threaded cylinder 45 connected to the upper end of the sheath 44. As shown in FIGS. 2 and 3, the cable 42 extends through an aperture 46 in the base of the air inlet. A pair of nuts 47 received on the threaded cylinder 45, one positioned on either side of the base are used to secure the cable 42 to the top cowling 16.

The inner wire 43 has a cylindrical terminal 48 and 49 at each end. The upper cylindrical terminal 48 is adapted to be engaged with a hook portion 51 formed on the bottom of the release lever 31.

Below the aperture 46, the cable 42 extends downward along the inside wall of the top cowling 16 and is secured thereto by means of cable clamps 52. There is a bend at the lower portion of the cable 42 which gives it a generally L-shaped configuration.

Figure 5:
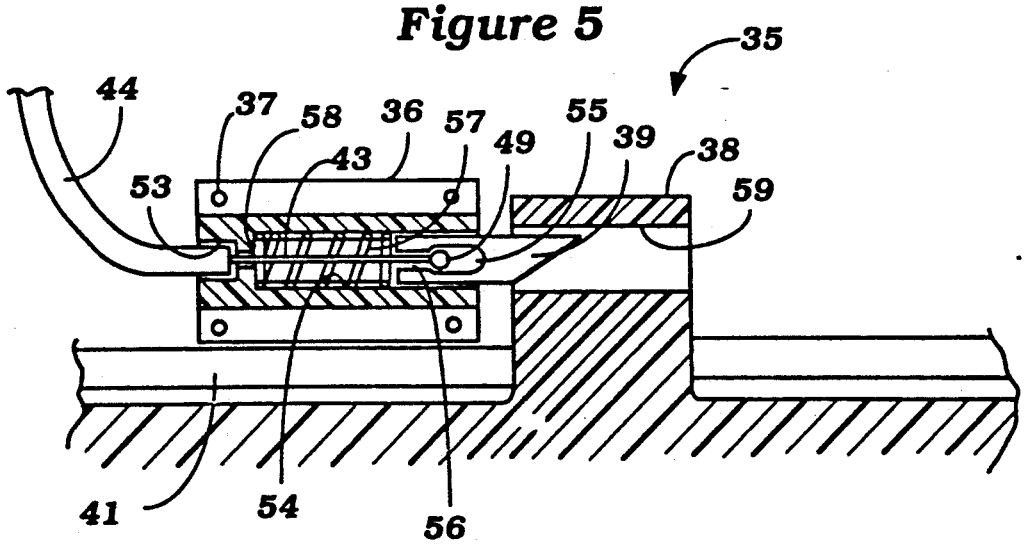
FIG. 5 is a cross sectional view taken along line 5—5 in FIG. 2 showing the locking mechanism.

Referring now to FIG. 5, in addition to FIG. 3, it will be seen that the lower end of the outer sheath 44 is seated in a smaller diameter bore 53 formed in one end of the first guide member 36 while the inner cable 43 extends through a small passageway into a larger diameter bore 54 formed in the other end of the first guide member 36. The plunger 39 is slidably supported in the larger diameter bore 54 and the lower terminal 49 of the inner cable 43 is adapted to be fitted in an aperture 55 formed in the plunger 39 through a slit 56 at one end of the plunger 39. A spring 57 encircles a portion of the inner wire 43 near its lower end and is seated within the larger diameter bore 54. One end of the spring 57 bears against the inner wall 58 of the larger diameter bore 54 while the other end engages the inner portion of the plunger 39 so as to urge the outer portion of the plunger 39 outward toward a bore 59 formed through the second guide member 38 when the top cowling 16 is fitted onto the tray 17.

The outer portion of the plunger 39 is tapered with its lower surface sloped upward toward the outer end. In the locked condition, as shown in FIG. 5, the tapered portion of the plunger 39 is urged into the bore 59 of the second guide member 38 by the force of the spring 57 so that the plunger 39 is engaged with both guide members 36 and 38. This securely locks the top cowling 16 to the tray 17.

Figure 6:
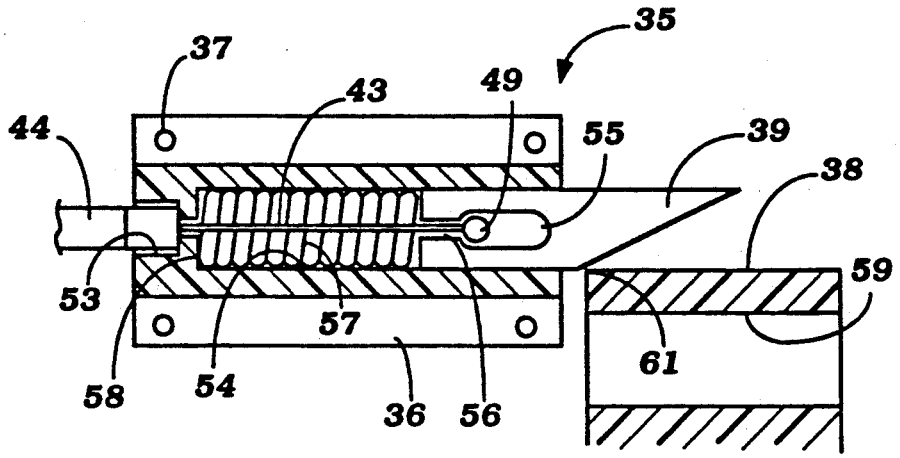
FIG. 6 shows the locking mechanism in its unlocked state when the top cowling portion is resting on and disconnected from the tray portion.
Figure 7:
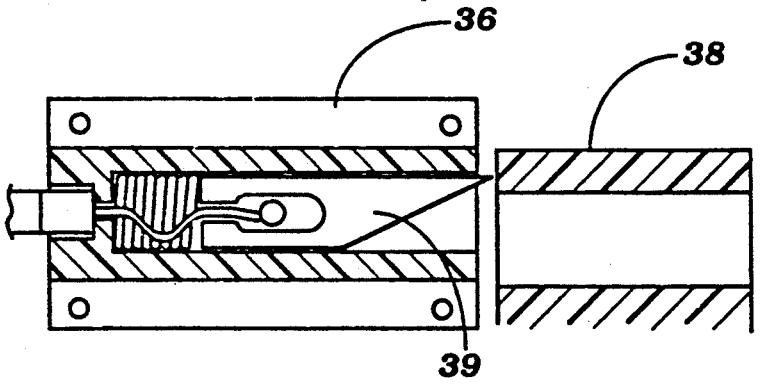
FIG. 7 shows the locking mechanism in its unlocked state as the top cowling portion is pressed down onto the tray.

The locking and the unlocking of the top cowling 16 to the tray portion 17 will now be described with particular reference to FIGS. 6, 7 and 8. After the top cowling 16 is placed on the tray 17 but before the two cowling components are locked, the plunger 39 is in contact with the upper inner edge 61 of the second guide member 38 but is disengaged from the bore 59 formed in the second guide member 38, as shown in FIG. 6. When the top cowling 16 is pushed down from this position, the sloped lower surface of the outer portion of the plunger 39 slides along the edge 61 of the second guide member 38 and, as a result, is urged further into the bore 54 of the first guide member 36 against the force of the spring 57, as shown in FIG. 7.

Figure 8:
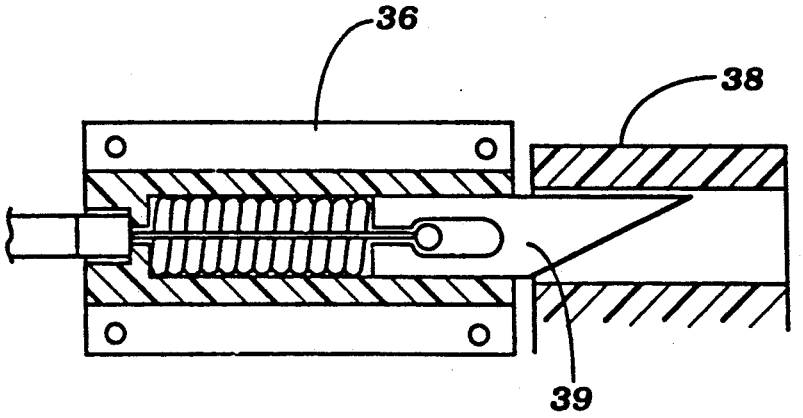
FIG. 8 shows the locking mechanism in its locked state wherein the top cowling portion and the tray are connected.

Then, as the top cowling 16 is pushed down even further so that the bores 54 and 59 of the first and second guide members 36 and 38 are aligned coaxially, the tapered portion of the plunger 39 is projected into the bore 59 of the second guide member 38 by the force of the spring 57, as shown in FIG. 8. As a result of this connection wherein the plunger 39 spans both guide members 36 and 38, the top cowling 16 is securely locked to the cowling tray 17.

In this locked state, the top surface of the outer portion of the plunger 39 keeps the top cowling 16 from inadvertently becoming detached from the tray 17 even when there is a force acting on the top cowling 16 to separate it from the tray 17. This is because the top surface of the outer portion of the plunger 39 is not sloped but instead is perpendicular to the separating movement of the top cowling 16. Hence, the top cowling 16 and tray 17 are maintained in the securely locked state until it is desired to unlock them.

To unlock the top cowling 16 from the tray 17, the release lever 31 is rotated upward about the pin 32 from the position shown in solid lines in FIG. 2 to the position shown in phantom in FIG. 2. The movement of the lever 31 is then transmitted to the plunger 39 by means of the inner wire 43 which is attached to the lever 31 and plunger 39 through the terminals 48 and 49 respectively. The upward movement of the lever 31 exerts a pulling force on the inner wire 43. This will cause the plunger 39 to slide toward the inner wall 58 of the first guide member 36 against the biasing force of the spring 57.

When the lever 31 is pulled upward a sufficient amount, the tapered portion of the plunger 39 will be completely removed from the bore 59 of the second guide member 38 to unlock the top cowling 16 from the tray 17. The amount of upward pull or input exerted on the lever 31 required to disengage the plunger 39 from the bore 59 of the second guide member 38 may be adjusted by, for example, adjusting the length of the cable 42.

When the plunger 39 is completely disengaged from the bore 59 of the second guide member 38, the top cowling 16 may be detached from the tray 17. This may be accomplished by inserting a hand in a handhold opening (not shown) formed between the air duct molding 27 and the air inlet and pulling the back of the top cowling 16 upward while maintaining the lever 31 in its upward position with the other hand so as to separate the first and second guide members 36 and 38. The lever 31 may then be released and allowed to return to its downward position and the top cowling 16 removed from the tray 17.

By positioning the release lever 31 for operating the locking mechanism 35 on the upper portion of the top cowling 16, the lever 31 is easily accessible and operable. Moreover, with the lever 31 so positioned, the top cowling 16 can be easily dismounted from the tray 17 without leaning out of the watercraft and reaching around the power head of the outboard motor 11. In the illustrated embodiment, the lever 31 is positioned at the rear of the upper surface of the top cowling 16. However, it should be noted that the lever 31 may alternatively be positioned at the front or side of the upper surface of the top cowling 16 within easy reach of the operator's hand.

The locking device also allows for easy connection of the top cowling 16 to the tray 17 by simply placing the top cowling 16 onto the tray 17 and pushing down on the top cowling 16 until the tapered portion of the plunger 39 engages the bore 59 of the second guide member 38.

It should be readily apparent from the foregoing description that a very effective and easily operable and accessible locking device for connecting and disconnecting the top portion and the tray of a cowling of an outboard motor has been illustrated and described. Although an embodiment of the invention has been illustrated and described, various changes and modifications may be made without departing from the spirit and scope of the invention, as defined by the appended claims. For example, instead of using the cable for mechanically transmitting the movement of the operating mechanism to the locking mechanism, an electrical system may be employed in which the locking mechanism is of an electrical type such as a solenoid lock and the operating mechanism includes a position detector such as a potentiometer for detecting the movement of the lever and transmitting an electrical signal to the locking mechanism to controlling it.

I claim:

1. A locking device for connecting a top portion and tray of a cowling for an outboard motor comprising an operating mechanism positioned on an upper surface of the top portion of said cowling and moveable relative to the top portion, a locking mechanism positioned remotely from said operating mechanism for connecting the top portion and tray of said cowling with each other, and means for transmitting movement of said operating mechanism to said locking mechanism for unlocking the top portion and tray of said cowling from each other.

2. A locking device as recited in claim 1, wherein said transmitting means comprises a cable having an outer sheath and an inner wire slidably supported within said outer sheath.

3. A locking device as recited in claim 2, wherein said operating mechanism comprises a pin affixed on the top portion of said cowling and a release lever pivotally supported on said pin.

4. A locking device as recited in claim 3, wherein said release lever has a hook portion for engaging one end of said inner wire.

5. A locking device as recited in claim 3, wherein said release lever is positioned at the rear of the upper surface of the top portion of said cowling.

6. A locking device as recited in claim 1, wherein said locking mechanism comprises a first guide member affixed to the top portion of said cowling and a second guide member affixed to the tray of said cowling, said guide members being positioned so that they are adjacent to one another when the top portion is fitted on the tray.

7. A locking device as recited in claim 6, wherein said locking mechanism further comprises a movable member slidably supported within said first guide member and selectively engageable with said second guide member.

8. A locking device as recited in claim 6, wherein said first and second guide members have first and second bores respectively formed therein, said bores being so positioned so that they are aligned with one another when the top portion of said cowling is fitted on the tray of said cowling.

9. A locking device as recited in claim 8, wherein said locking mechanism further comprises a movable member slidably supported within the first bore of said first guide member and selectively engageable with the second bore of said second guide member.

10. A locking device as recited in claim 9, wherein said locking mechanism further comprises a biasing member positioned within the first bore and engageable with said movable member to urge said movable member toward the second bore when the top portion of said cowling is fitted on the tray of said cowling.

11. A locking device as recited in claim 9, wherein said movable member includes an outer portion that is tapered.

12. A locking device as recited in claim 9, wherein said operating mechanism comprises a pin affixed on the top portion of said cowling and a release lever pivotally supported on said pin.

13. A locking device as recited in claim 12, wherein said transmitting means comprises a cable including a wire having a pair of ends, one end being attached to said release lever and the other end being attached to said movable member.

14. A locking device as recited in claim 13, wherein said cable further comprises an outer sheath in which said wire is slidably supported.

15. A locking device as recited in claim 12 wherein said release lever is positioned at the rear of the upper surface of the top portion of said cowling.

* * * * *